US010501306B2

(12) United States Patent
Donabauer et al.

(10) Patent No.: US 10,501,306 B2
(45) Date of Patent: Dec. 10, 2019

(54) COOLED BEVERAGE DISPENSING ASSEMBLY, TAP AND METHOD THEREFOR

(71) Applicant: HEINEKEN SUPPLY CHAIN B.V., Amsterdam (NL)

(72) Inventors: Alfred Josef Donabauer, Amsterdam (NL); Peter Henri Samuel Wigman, Amsterdam (NL); Helmut Viktor Maria Paulitsch, Amsterdam (NL)

(73) Assignee: HEINEKEN SUPPLY CHAIN B.V., Amsterdam (NL)

( * ) Notice: Subject to any disclaimer, the term of this patent is extended or adjusted under 35 U.S.C. 154(b) by 0 days.

(21) Appl. No.: 15/504,359

(22) PCT Filed: Aug. 28, 2015

(86) PCT No.: PCT/NL2015/050598
§ 371 (c)(1),
(2) Date: Feb. 16, 2017

(87) PCT Pub. No.: WO2016/032333
PCT Pub. Date: Mar. 3, 2016

(65) Prior Publication Data

US 2017/0233237 A1 Aug. 17, 2017

(30) Foreign Application Priority Data

Aug. 28, 2014 (NL) ..... 2013377

(51) Int. Cl.
*B67D 1/00* (2006.01)
*B67D 1/08* (2006.01)

(52) U.S. Cl.
CPC ..... *B67D 1/0867* (2013.01); *B67D 1/0004* (2013.01); *B67D 1/0082* (2013.01);
(Continued)

(58) Field of Classification Search
CPC .. B67D 1/0867; B67D 1/0004; B67D 1/0082; B67D 1/0875; B67D 2001/0098;
(Continued)

(56) References Cited

U.S. PATENT DOCUMENTS 1,923,585 A 8/1933 Reeves
2,175,669 A 10/1939 Rice
(Continued)

FOREIGN PATENT DOCUMENTS

DE 20122351 U1 4/2005
DE 202005019217 A1 4/2007
(Continued)

*Primary Examiner* — Frederick C Nicolas
(74) *Attorney, Agent, or Firm* — Pearne & Gordon LLP

(57) ABSTRACT

Beverage dispensing assembly, including a tapping column and a tap connected to the tapping column at a first end thereof, wherein the tapping column includes a first and a second channel, in fluid communication near the tap, and a beverage line extending through one of the first and second channels and connected to the tap, wherein the assembly includes a first part and a second part for connecting the tap to the column, the second part at least partly surrounding the first part, wherein the first part is made of a first material and the second part is made of a second material, the second material having a heat conductivity which is higher than the heat conductivity of the first material, wherein the beverage line is connected to the first part and the second part extends into and/or forms part of a wall of a chamber into which the first and second channel open, forming the fluid connection.

25 Claims, 16 Drawing Sheets

Figure 1:
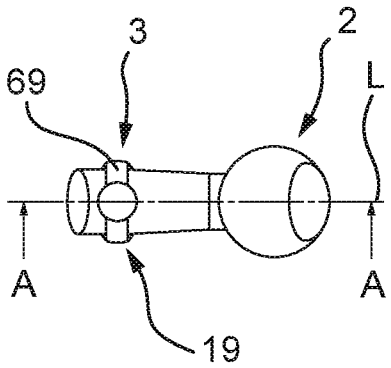

(52) U.S. Cl.
CPC .... *B67D 1/0875* (2013.01); *B67D 2001/0098* (2013.01); *B67D 2210/00044* (2013.01)

(58) Field of Classification Search
CPC ..... B67D 2210/00044; B67D 1/0868; B67D 1/0872; B67D 2001/1494
See application file for complete search history.

(56) References Cited

U.S. PATENT DOCUMENTS

| | | | | |
|---|---|---|---|---|
| 6,598,417 | B1 * | 7/2003 | Wilkes ..... | B67D 1/0861 222/146.6 |
| 6,832,487 | B1 | 12/2004 | Baker | |
| 7,062,937 | B1 | 6/2006 | Baker | |
| 7,661,556 | B2 | 2/2010 | Van Der Klaauw et al. | |
| 7,762,431 | B1 | 7/2010 | Tuyls et al. | |
| 8,757,445 | B2 | 6/2014 | Robinson | |
| 2004/0069368 | A1 | 4/2004 | Van Der Klaauw et al. | |
| 2008/0163641 | A1 | 7/2008 | Mitchell | |

FOREIGN PATENT DOCUMENTS

| | | | |
|---|---|---|---|
| EP | 1289874 | A2 | 3/2003 |
| EP | 1775257 | A1 | 4/2007 |
| EP | 1939558 | A1 | 7/2008 |
| GB | 2363191 | A | 12/2001 |
| WO | 0192144 | A2 | 12/2001 |
| WO | 2006103566 | A2 | 10/2006 |

* cited by examiner

COOLED BEVERAGE DISPENSING ASSEMBLY, TAP AND METHOD THEREFOR

The invention relates to a beverage dispensing assembly. The invention further relates to a tap of or for use in a beverage dispensing assembly. The invention further relates to a method for dispensing of beverage.

Beverage dispensing assemblies are known in the art in different constructions, for both on and off premise use.

It is known to dispense beverages such as carbonated beverages, especially beer from a rigid metal or wooden container such as a keg, barrel or cask by feeding pressurised gas, such as CO2 into the container, forcing the beverage out of the container.

EP1289874 discloses a tapping assembly having a disposable beverage line extending through one of a first and second channel in a tapping column, the beverage line forming a part of a dispense valve. The first and second channel are in fluid communication at an upper end of the column, near the tap, such that a cooling medium, preferably air, can be circulated through the first and second channel for cooling the beverage line up to the tap.

WO2006/103566, referring to EP1289874 discusses a beverage dispensing assembly in which separate cooling circuits are provided for cooling the tapping column as such and cooling the beverage line within the tapping column. In WO2006/103566 the tap as such is not discussed and can be a standard tap.

U.S. Pat. No. 8,757,445B2 discloses a tapping assembly in which the tap is entirely encompassed by a cold block for cooling the tap during and also in between servings of beverage. The tap of U.S. Pat. No. 8,757,445B2 is specifically designed in order to be useable in such system. U.S. Pat. No. 8,757,445B2 discusses prior art systems for cooling beverage lines and beverage taps, for example in FIG. 10 thereof, all failing to disclose a system according to the present disclosure.

The present invention aims at providing an alternative tapping assembly. The present invention aims at providing a beverage dispensing assembly that is easy to operate and maintain, in which cooling of the beverage can be achieved as far as into the tap.

At least one of these aims can at least partly be achieved, individually or in combination, by a beverage dispensing assembly and/or tap according to this disclosure. Other aims and advantages may be alternatively or additionally be obtained by the invention.

In an aspect a dispensing assembly according to the disclosure can comprise a tapping column and a tap connected to the tapping column at a first end thereof, wherein the tapping column comprises a first and a second channel, in fluid communication near the tap, and a beverage line extending through one of the first and second channels and connected to the tap. The first and second channel can be in fluid connection with each other in a chamber and the tap can have an end which extends into said chamber, such that at least part of said chamber extends around an outside part of said end. The beverage line extends through said chamber for connection to said end of the tap, such that during use beverage inside the tap is cooled by thermal conduction from cooling medium flowing through said chamber. The tap can be provided with a thermal insulation shield.

During use in a dispensing assembly of the present disclosure the tap can predominantly be cooled by cooling fluid flowing through a chamber into which an end of the tap extends, whereas the beverage line is cooled by said cooling fluid flowing to and/or from said chamber. The tap is heat insulated by a shield, such that the tap is prevented from being warmed by for example air surrounding the tap or users handling the tap. By keeping the tap relatively cool the micro climate and micro biology of the tap can be improved. By using a chamber into which part of the tap extends intensive cooling of said end can be obtained, which can cool the further tap by conduction. This means that the cooling fluid can have a relatively low temperature, without the risk of cooling the tap and, especially beverage enclosed therein, too far. By preventing the temperature of the tap to be reduced too far and/or by providing the heat insulating shield condensation of water vapor in the air on the tap can largely be prevented.

In an aspect the present invention can be characterised by a beverage assembly comprising a tapping column and a tap connected to the tapping column at a first end thereof, wherein the tapping column comprises a first and a second channel, in fluid communication near the tap, and a beverage line extending through one of the first and second channels and connected to the tap. The tap can comprise a first part and a second part, the second part at least partly surrounding the first part. The first part can be made of a first material and the second part of a second material. The second material can have a heat conductivity which is higher than the heat conductivity of the first material. The beverage line is connected to the first part and the second part extends into and/or forms part of a wall of a chamber into which the first and second channel open, forming the fluid connection between the first and second channel.

In a second aspect the present invention can be characterised by a beverage dispensing assembly, comprising a tapping column and a tap connected to the tapping column at a first end thereof, wherein the tapping column comprises a first and a second channel, in fluid communication near the tap, and a beverage line extending through one of the first and second channels and connected to the tap. The tap can comprise a first part and a second part, the second part at least partly surrounding the first part. The first part can be made of a first material and the second part of a second material. The beverage line is connected to the first part and the second part extends into and/or forms part of a wall of a chamber into which the first and second channel open, forming the fluid connection between the first and second channel. Preferably the tap is provided with heat insulation for preventing warming of the beverage in the tap.

In a third aspect the present invention can be characterised by a tap comprising a beverage channel and a valve, wherein at least the beverage channel and the valve are heat insulated.

In a fourth aspect the present invention can be characterised by a method for cooling beverage, especially beer, wherein the beverage is fed to a tap through a beverage line forming part of a tube-in-tube line, such that a channel of the tube-in-tube line is formed surrounding the beverage line. The channel is in fluid connection with a second channel by a chamber at an upper end of a tapping column. A tap is connected to the tapping column and to the beverage line. A cooling medium is forced through the chamber in close contact with an end of the tap extending into said chamber, said end surrounded by part of said chamber, wherein the tap is cooled by heat conduction between said cooling medium and at least the said end of the tap. The tap can be shielded by a heat insulation shield.

Figure 2:
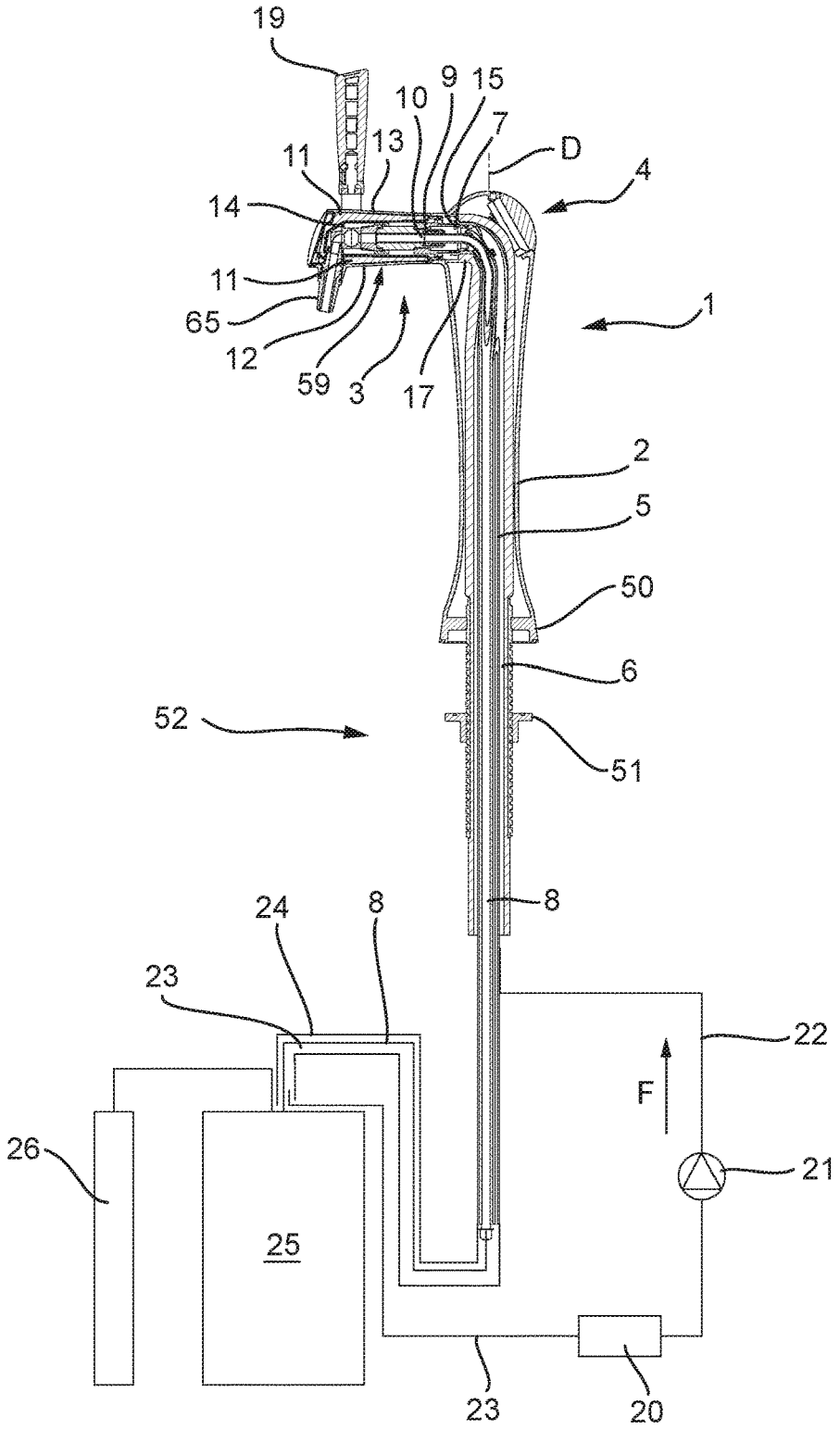
Figure 3A:
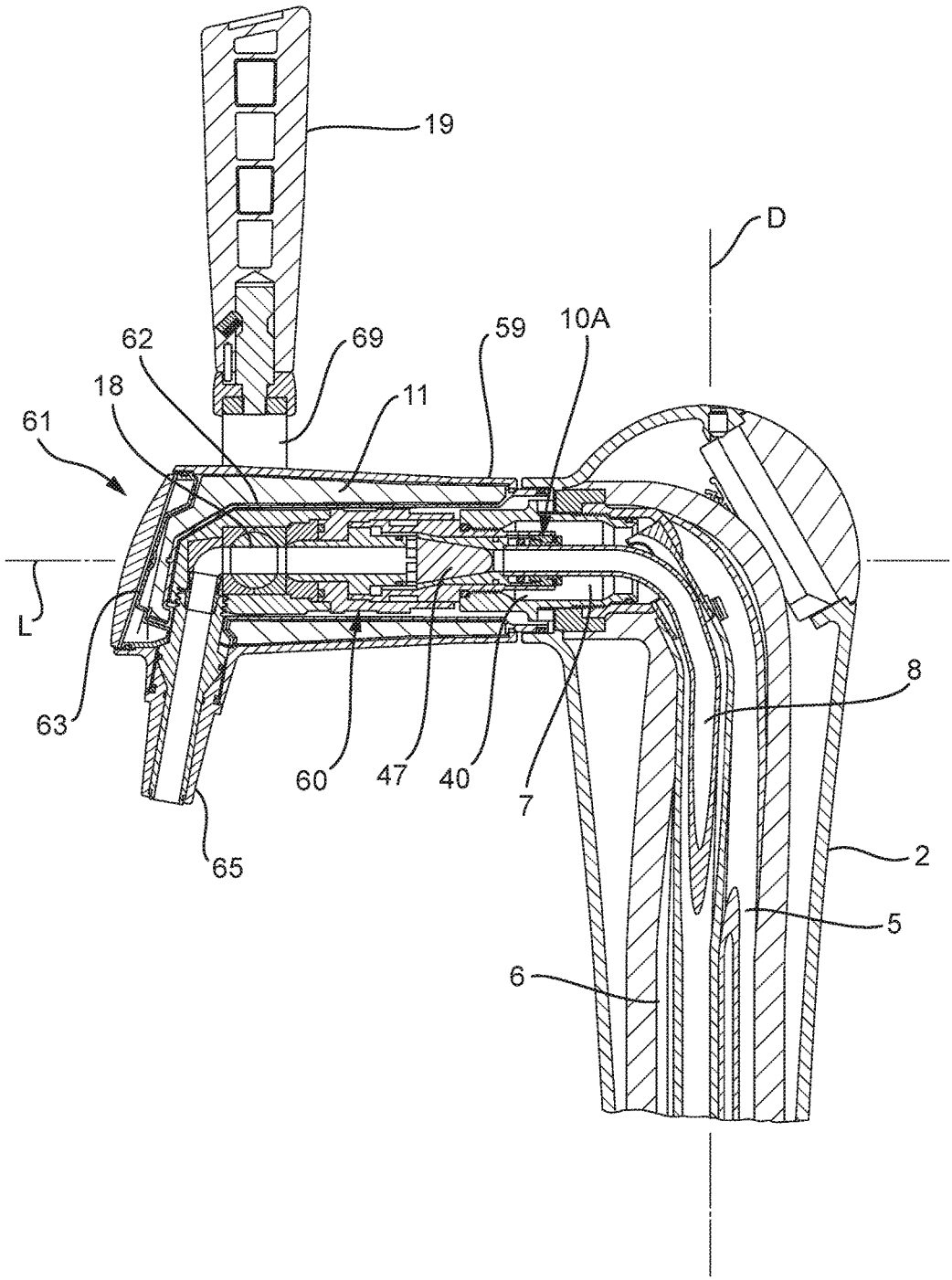
Figure 3B:
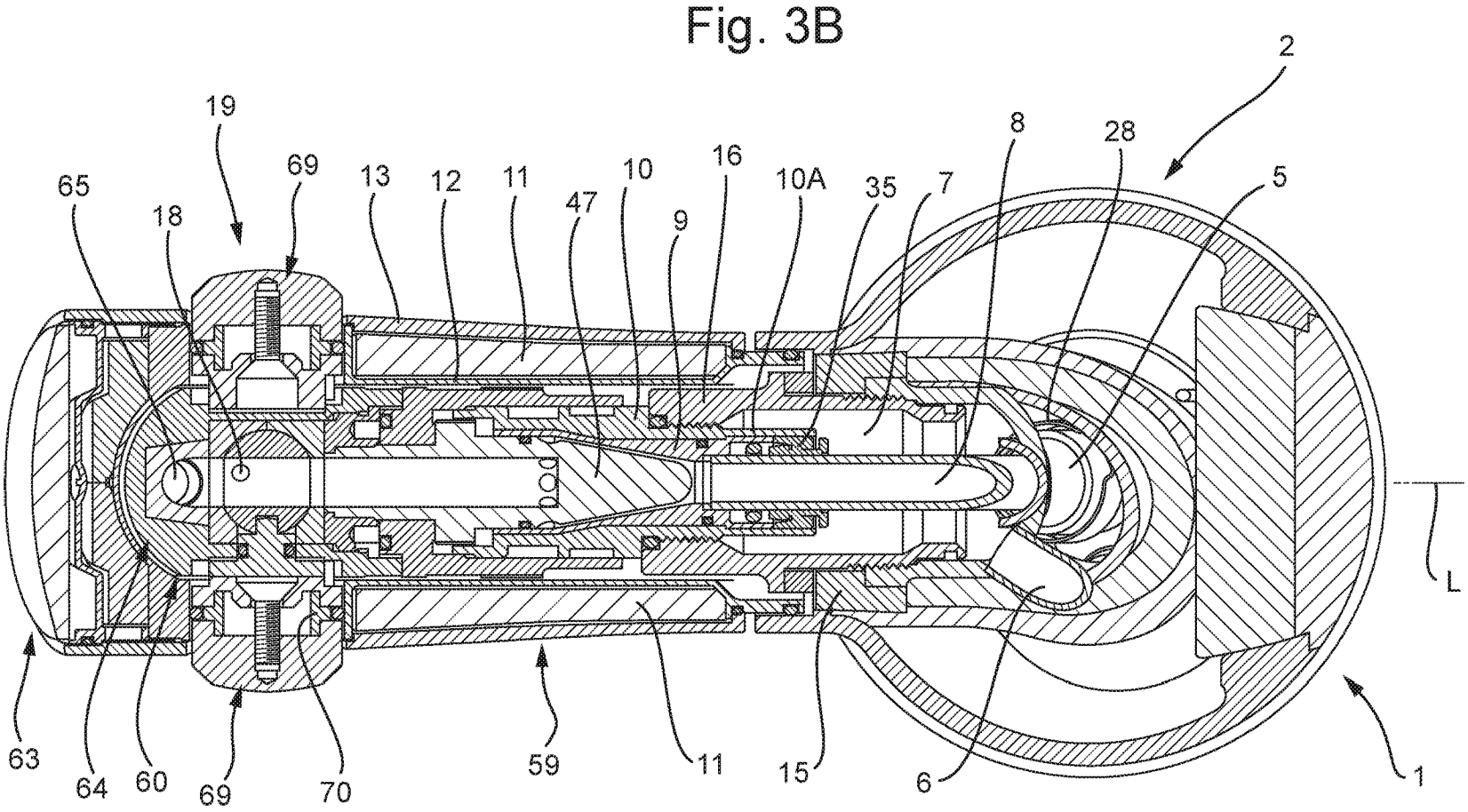
Figure 4:
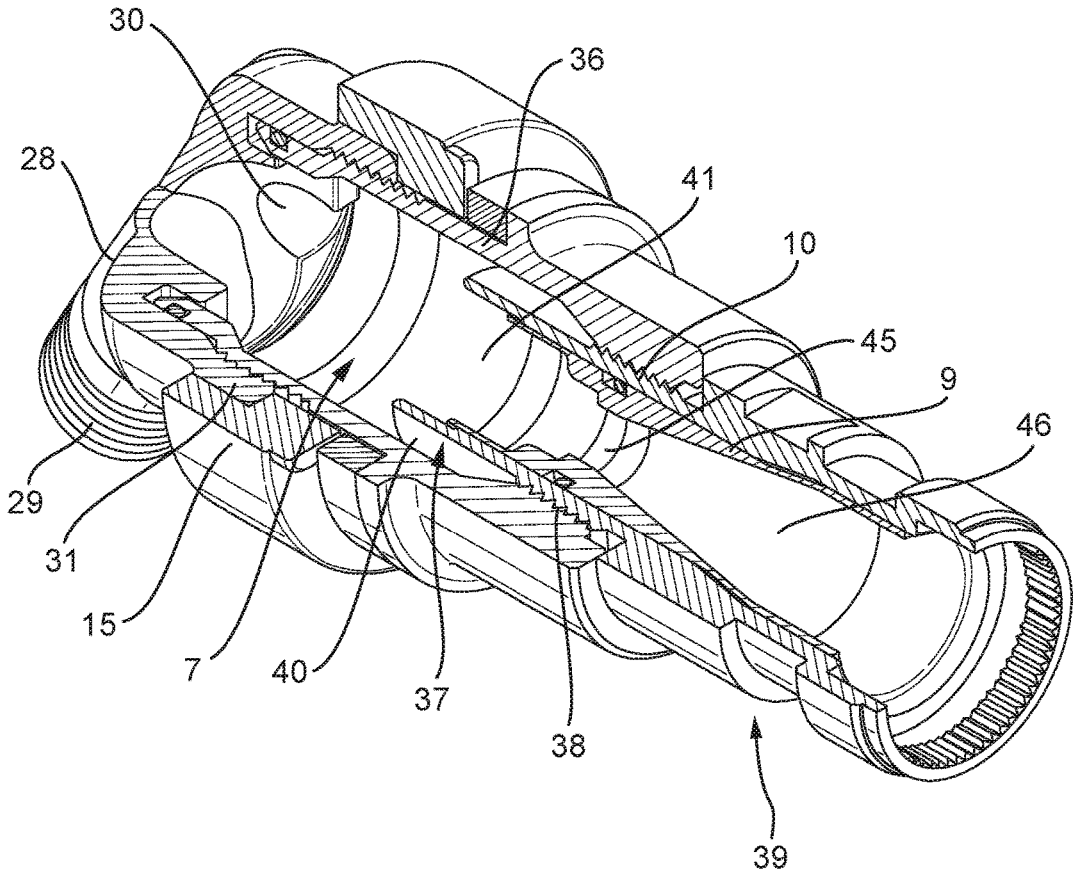
Figure 5:
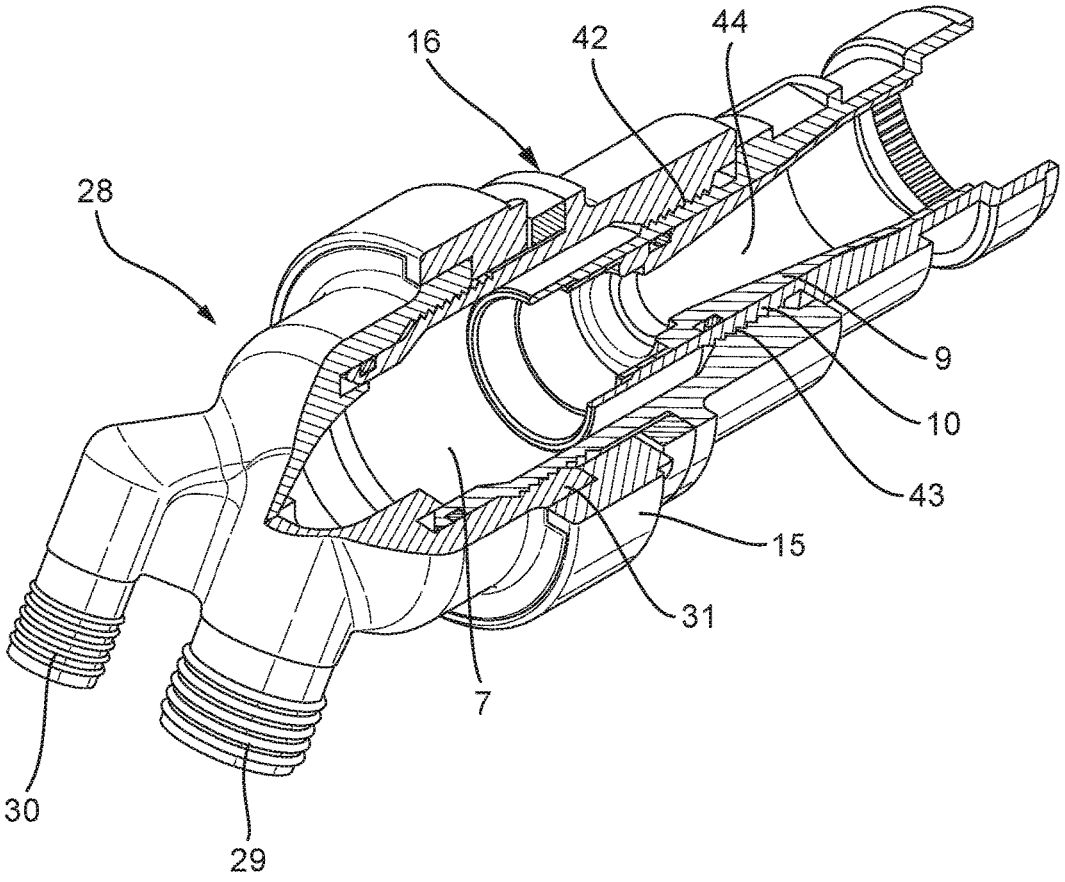
Figure 6A:
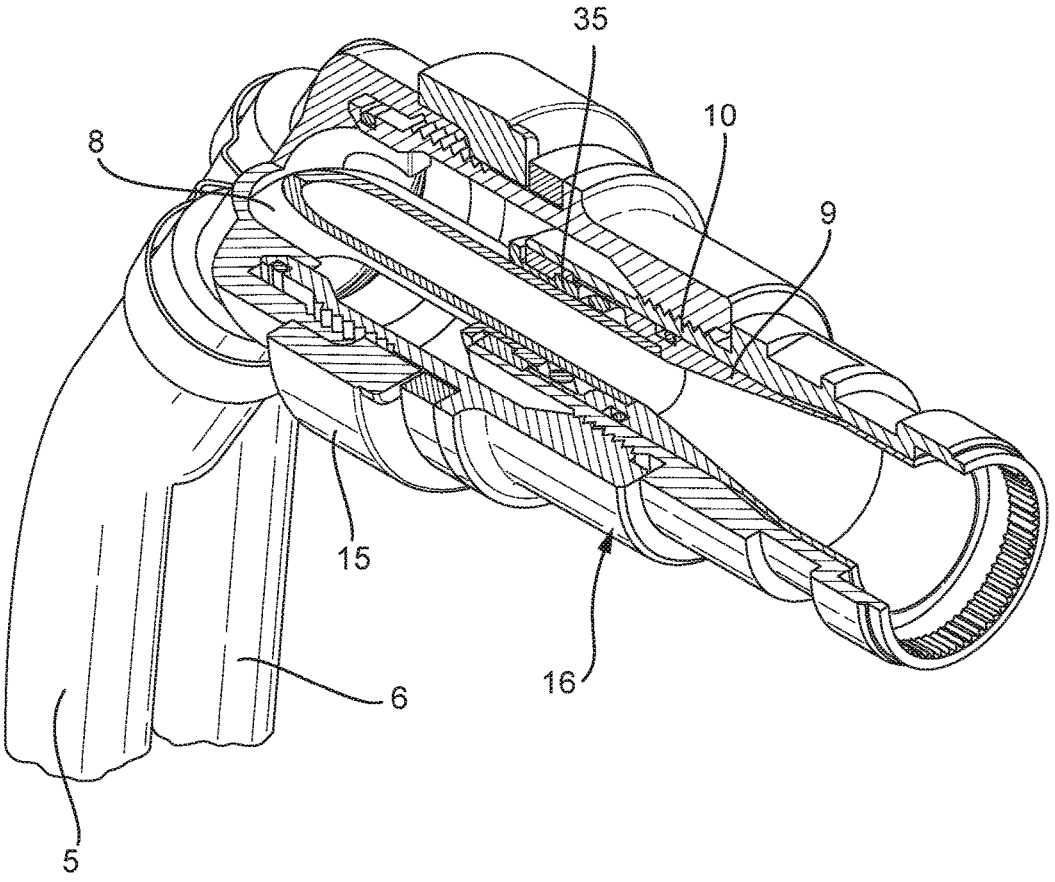
Figure 6B:
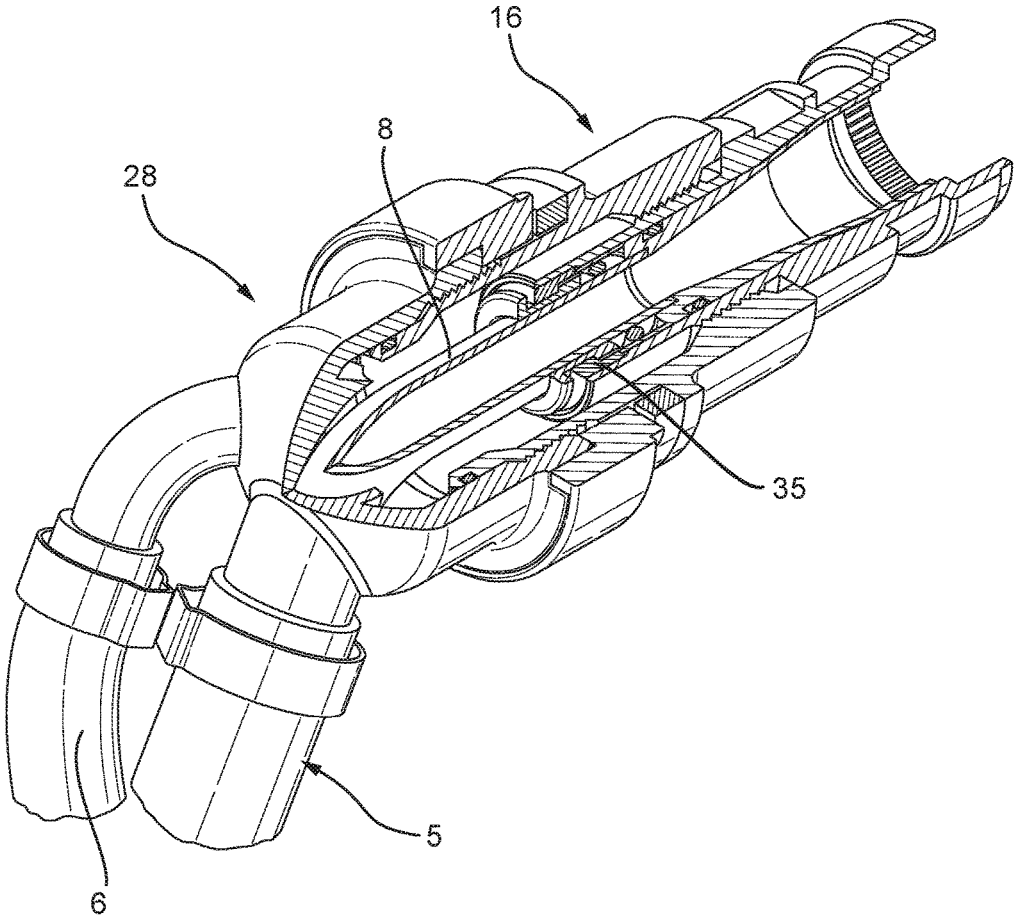
Figure 7:
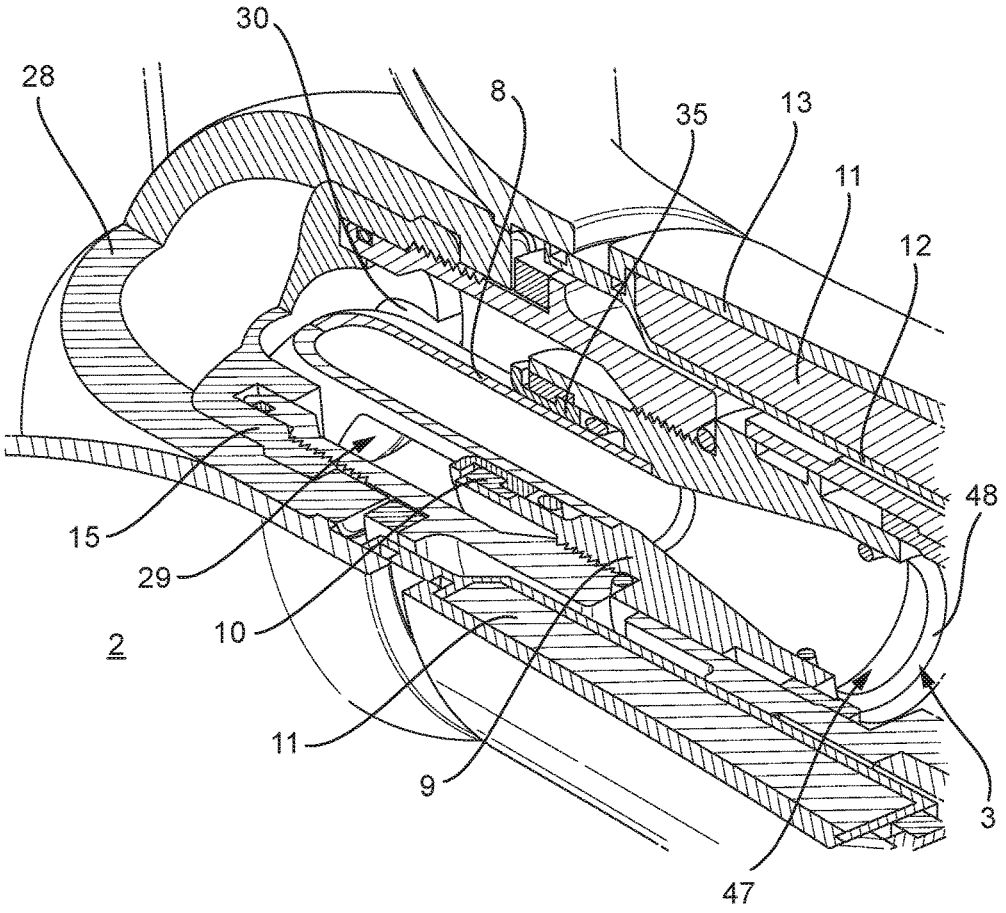
Figure 8:
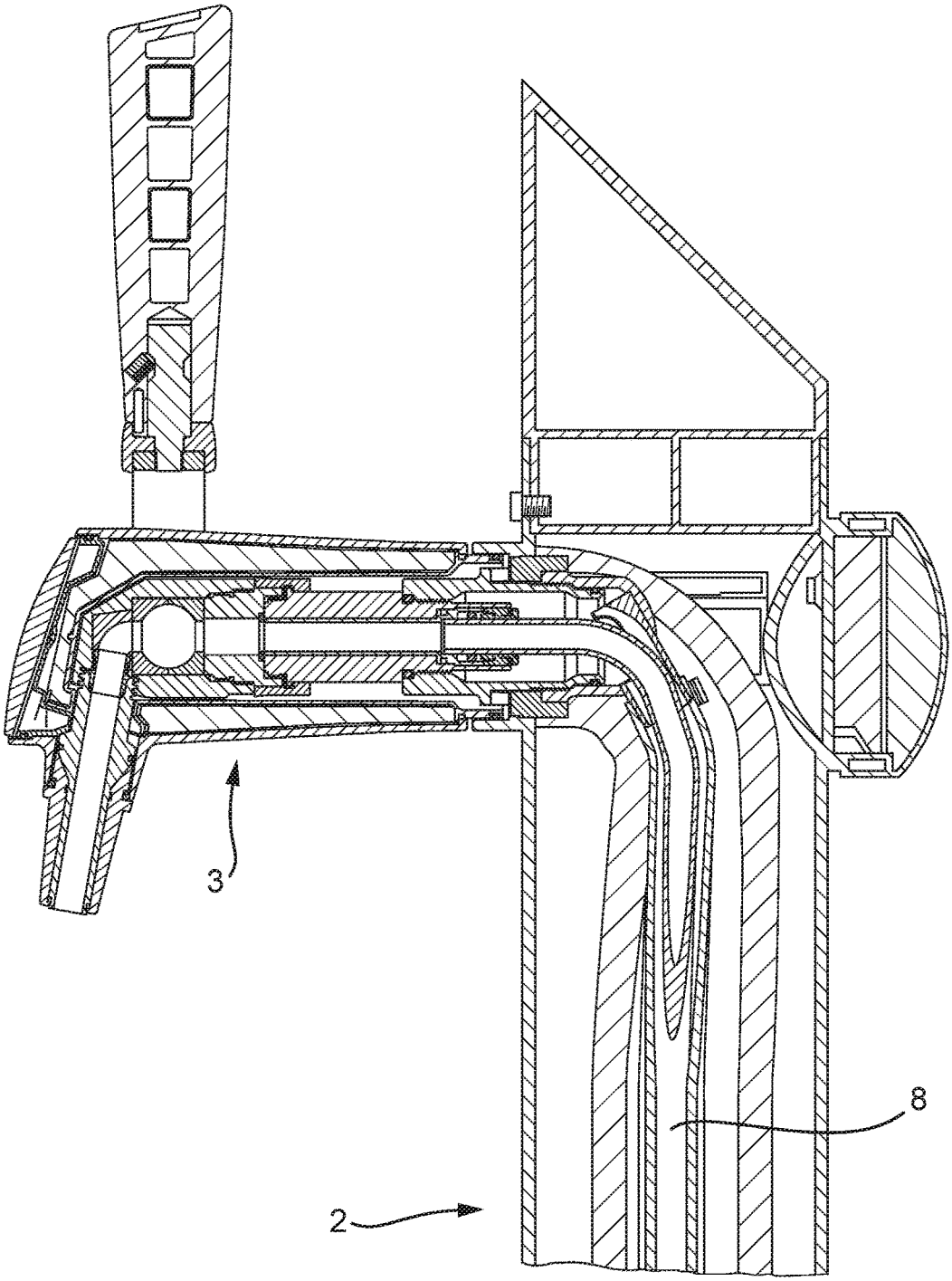
Figure 9:
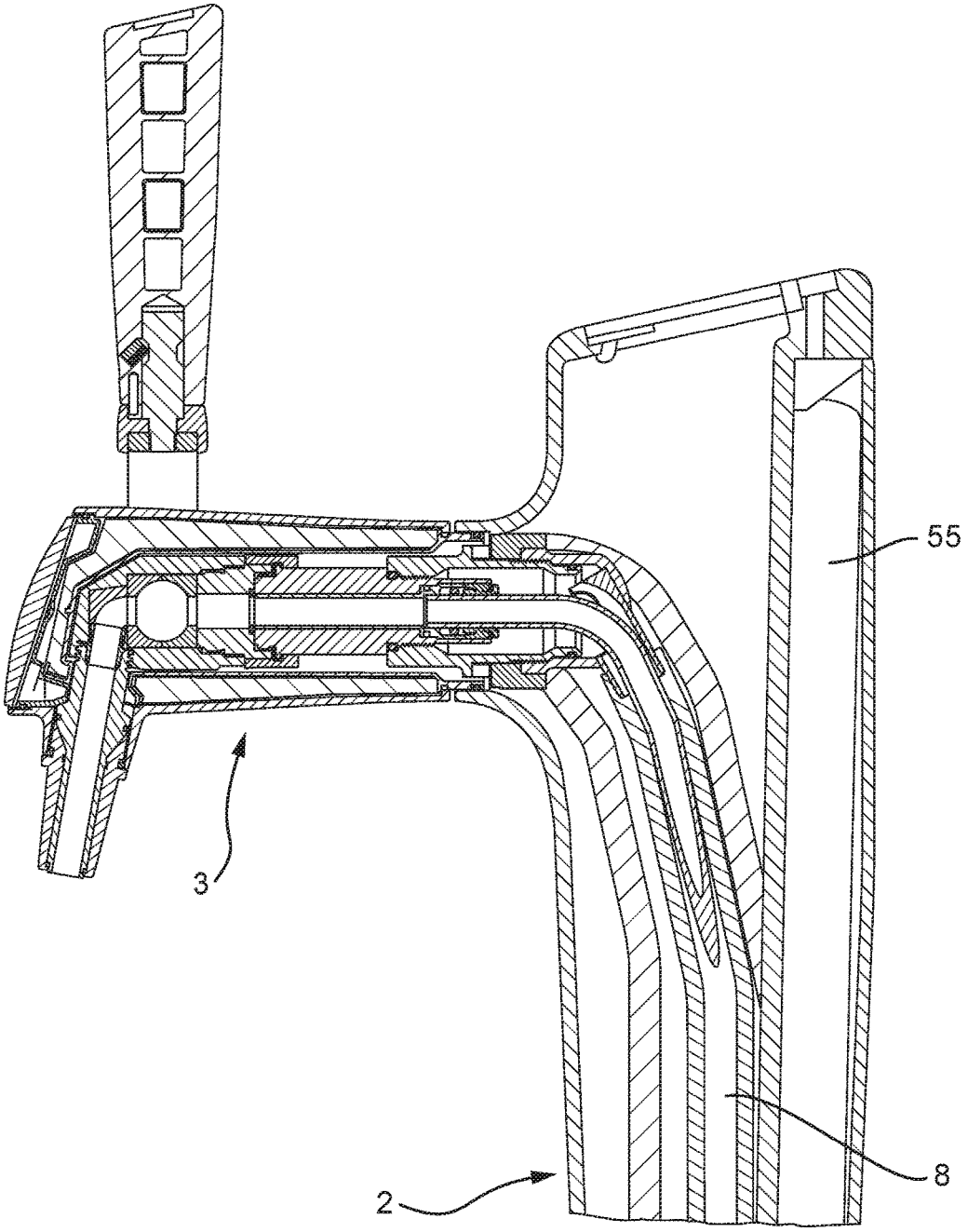
Figure 10:
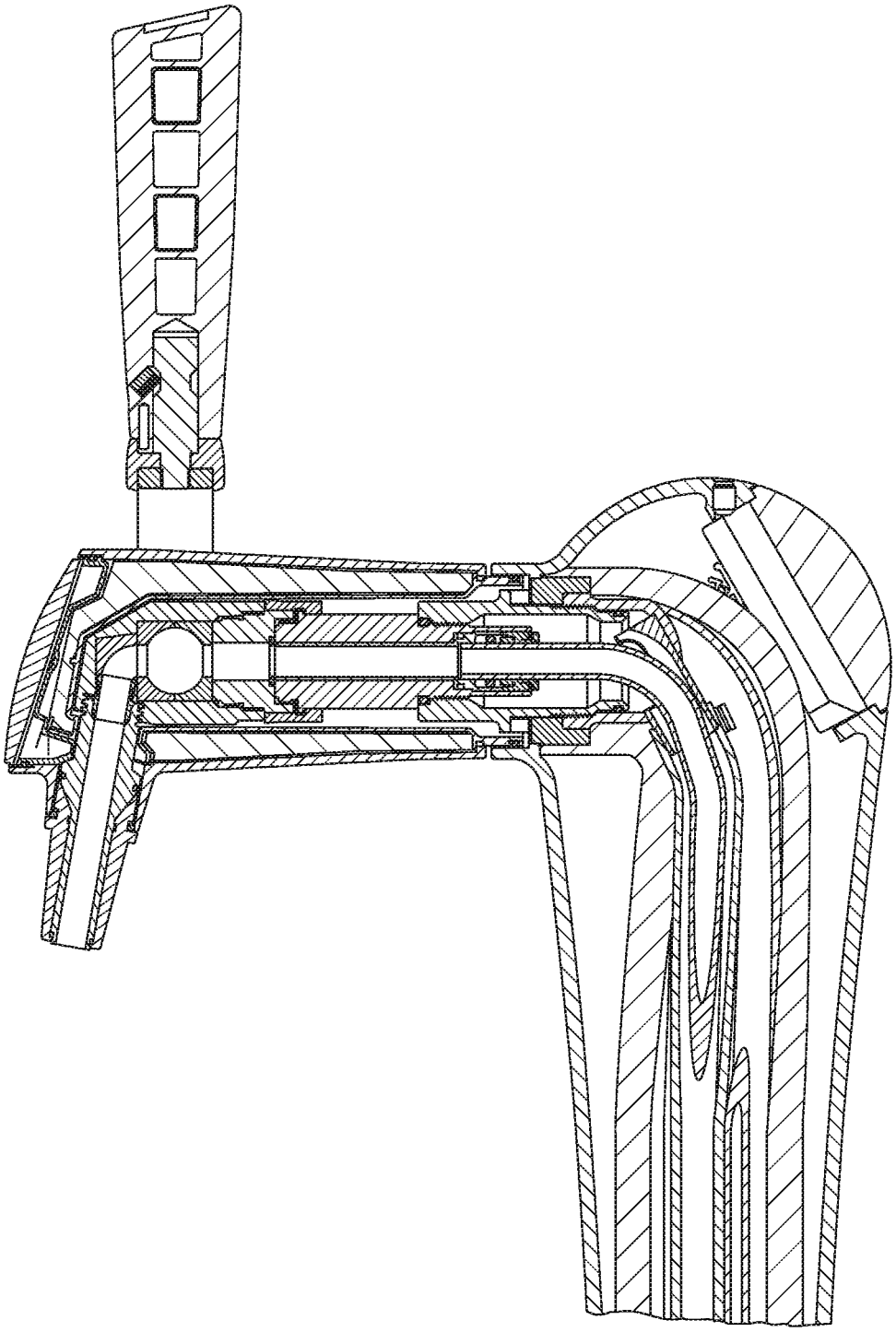
Figure 11:
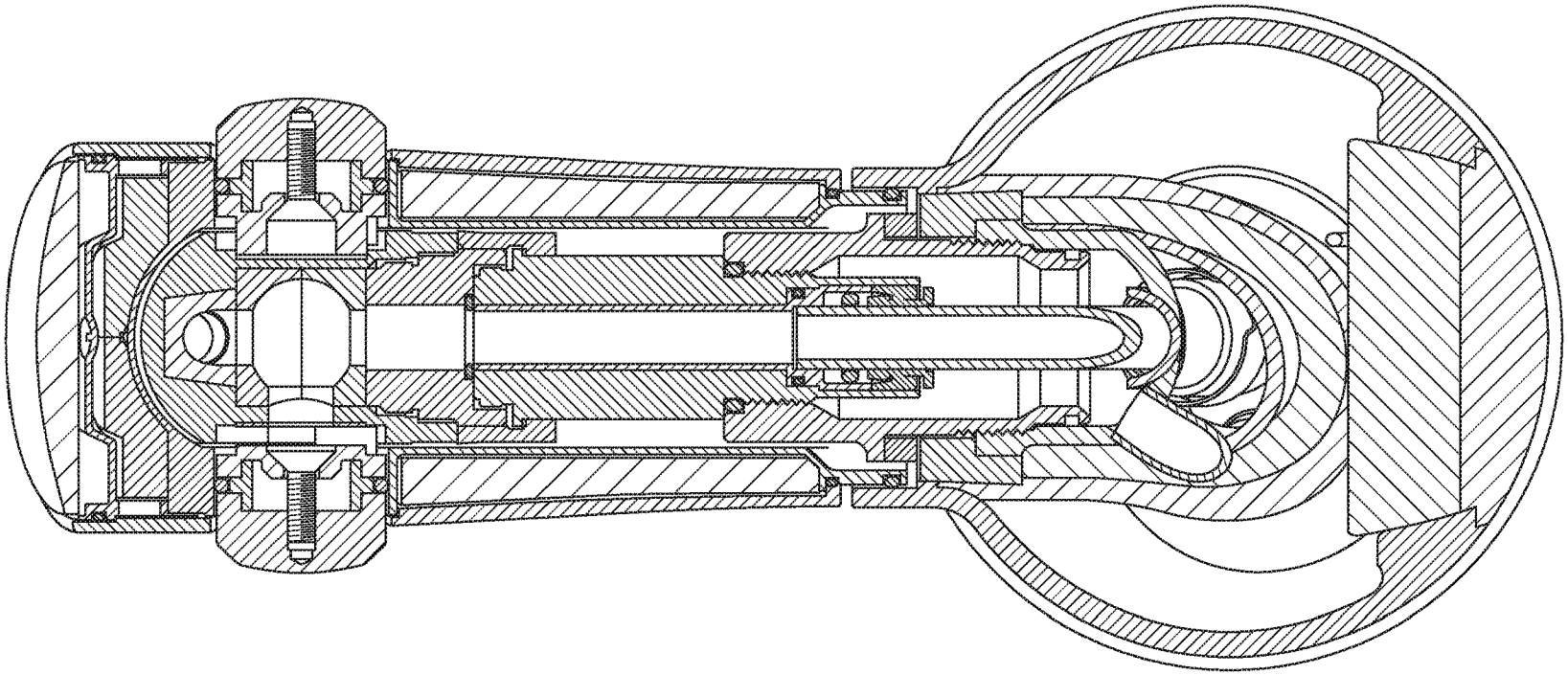
Figure 12:
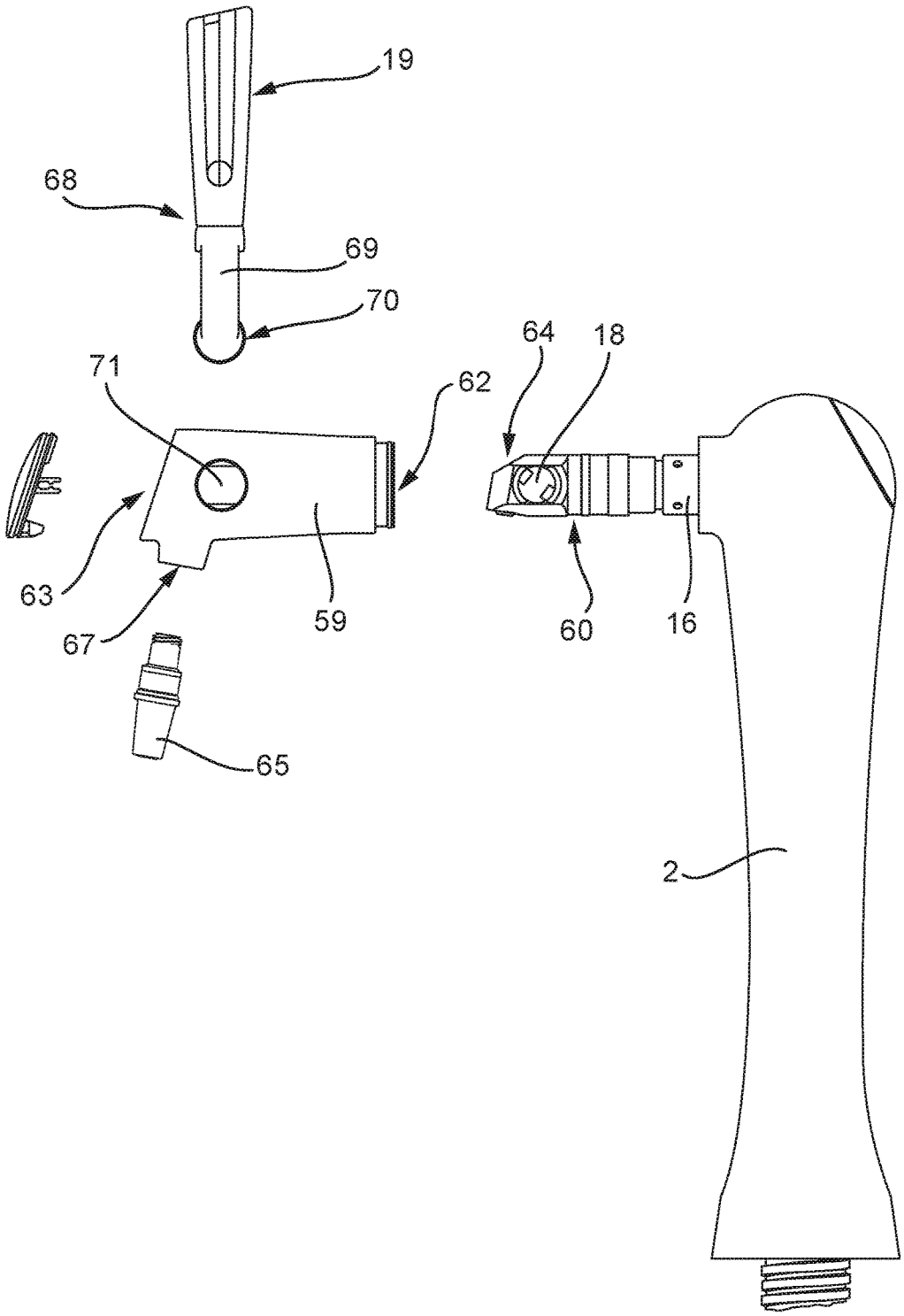

In order to further elucidate the present invention, embodiments thereof shall be disclosed and discussed hereafter, with reference to the drawings. Therein shows:

FIG. 1 schematically a top view of a tapping column with a tap;

FIG. 2 schematically a cross sectional view of a tapping column and tap along the line A-A in FIG. 1, connected to a beverage container and a cooling system;

FIG. 3A schematically an enlarged cross sectional view of an upper part of FIG. 2 along the line A-A in FIG. 1;

FIG. 3B schematically a horizontal cross sectional view of the upper part of FIG. 2 along line L in FIG. 3A;

FIGS. 4 and 5 schematically in perspective view partly taken away a connecting assembly for connecting a tap to a tapping column, a beverage line and cooling system, from two different angles;

FIGS. 6A and B schematically the connecting assembly of FIGS. 4 and 5 respectively, connected to a first and second channel;

FIG. 7 schematically at an enlarged scale part of a dispensing assembly showing inter alia the connection between the tap and the tapping column, between the beverage line and the tap and between two channels and a chamber connecting the two channels;

FIGS. 8 and 9 schematically two alternative embodiments of a tapping column for use in an assembly;

FIGS. 10 and 11 two cross sections of an alternative embodiment of an assembly of the present disclosure;

FIG. 12 a partially exploded view of a tapping column with valve; and

Figure 13:
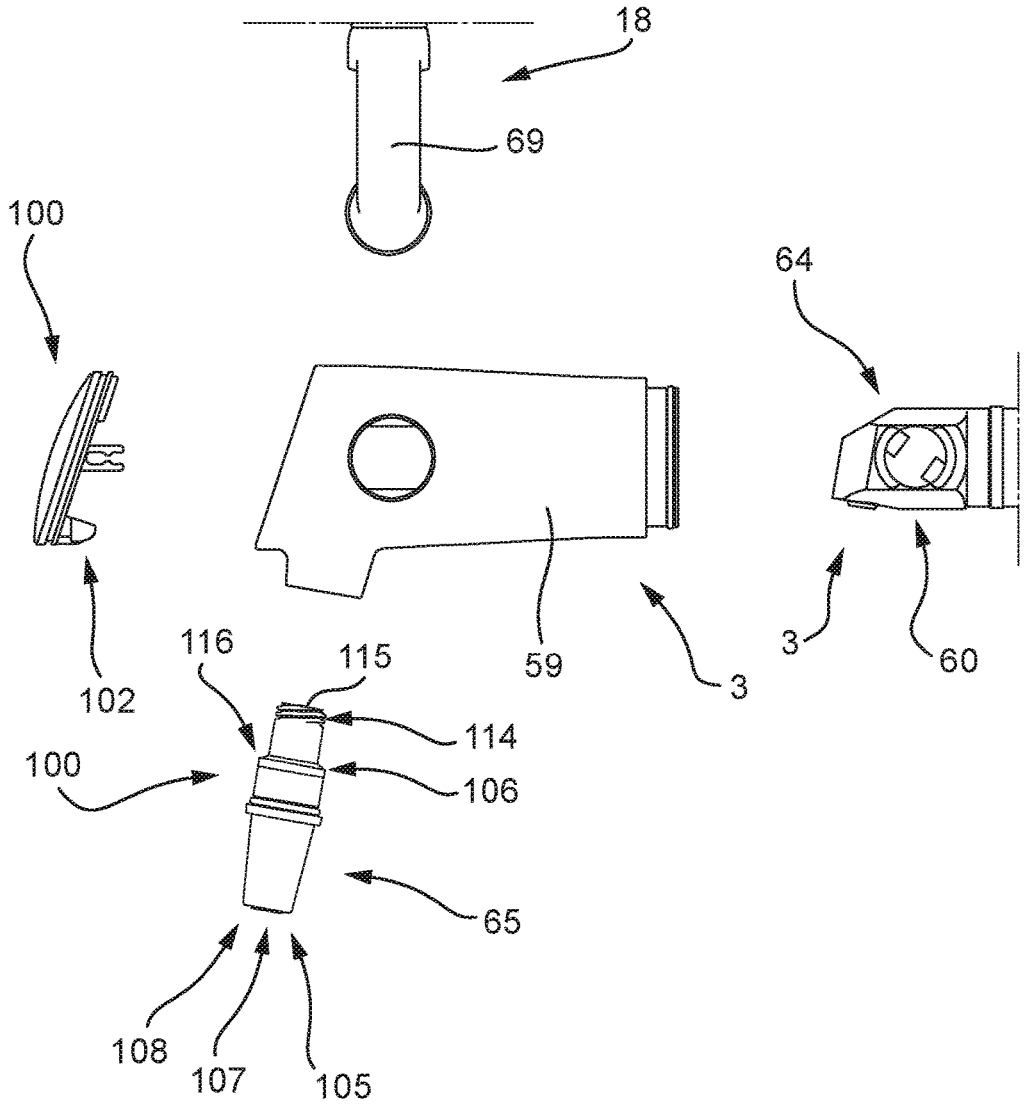
Figure 14:
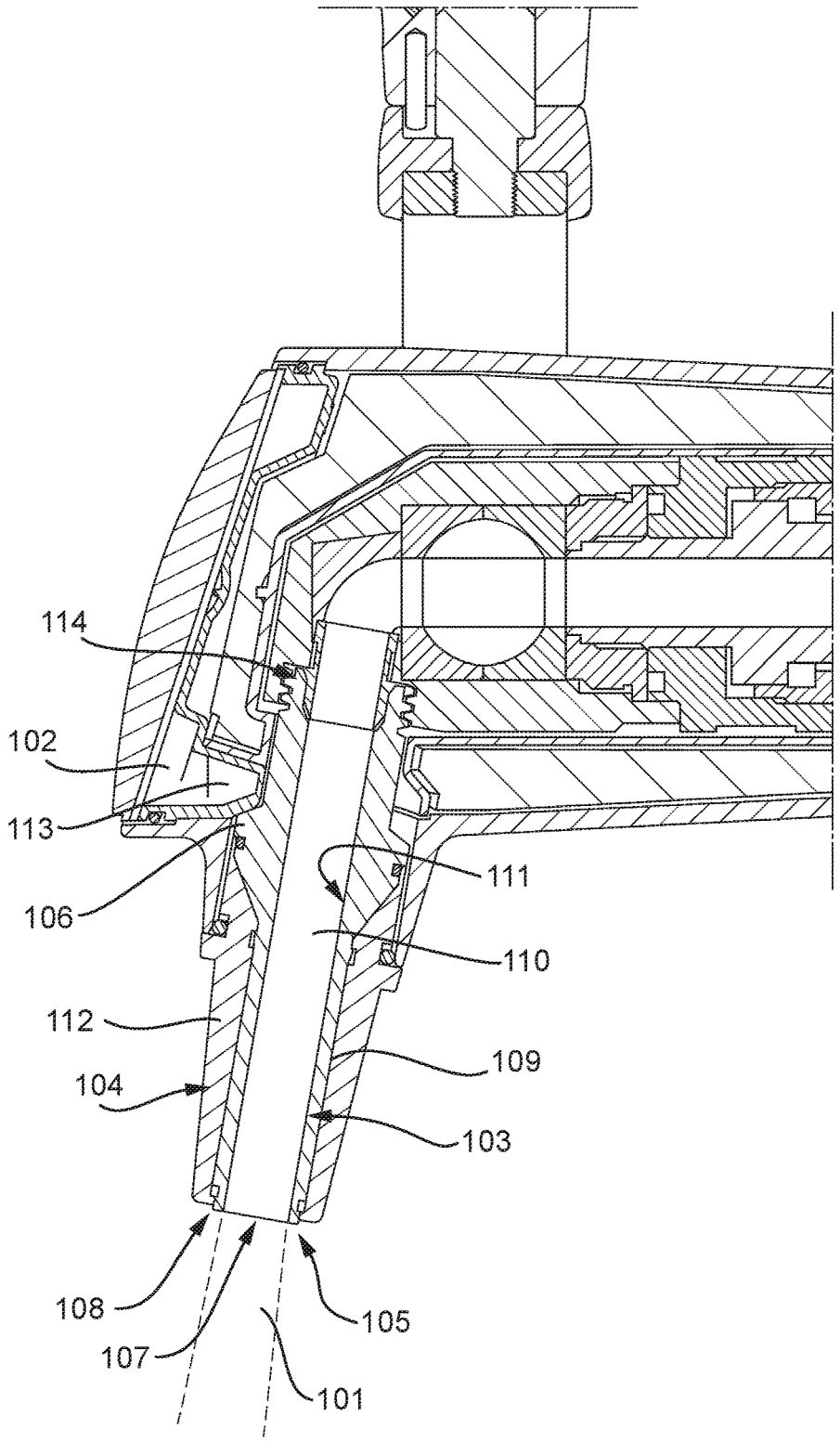

FIGS. 13 and 14 a lighting assembly and tap provided with such lighting assembly.

In this description embodiments are shown and disclosed of the invention, by way of example only. These should by no means be interpreted or understood as limiting the scope of the present invention in any way. In this description the same or similar elements are indicated by the same or similar reference signs. In this description embodiments of the present invention shall be discussed with reference to carbonated beverages, especially beer. However, other beverages could also be used in the present invention. In this description taps are disclosed, at least in some embodiments in a beverage dispensing assembly, which assembly is shown by way of example only. The same or similar taps can be used with different beverage dispense assemblies, including but not limited to the tapping assemblies as disclosed in the prior art as referred to in the introduction to this specification.

In this description references to above and below, top and bottom and the like shall be considered, unless specifically stipulated differently, to an orientation of system parts as usually used, as for example shown in FIG. 2. This does not necessarily reflect the orientation in which a tapping device of the present disclosure or parts thereof have to be used.

In this description a tapping assembly shall be described, comprising at least a tapping column, a container and a tap to which the container is to be coupled, as well as a source of pressurised gas, such as CO2. As pressure fluidum other gasses can however be used, such as air. The fluidum can be supplied in any suitable way, as is known in the art. The container can be of any suitable sort and construction such as but not limited to an ordinary single walled, metal or plastic beverage keg, a compressible beverage container or a Bag-in-Container or Bag-in-Bag type container. The beverage line can be a fixed beverage line or a disposable beverage line. The first should be understood as meaning a beverage line which is typically used for a series of containers and is cleaned in between being used for such containers. The latter should be understood as meaning that the beverage line is typically retracted from the tapping column and exchanged for a different beverage line whenever a new container is to be connected, as is for example disclosed in EP1289874.

In this description as a preferred cooling medium a liquid is described, such as but not limited to water and/or glycol or such product reducing the freezing temperature of water, such that the cooling medium will remain fluid even near or below a temperature of about 0° C. Nevertheless other cooling mediums can be used, such as gas, for example but not limited to air, for example air from a cooling unit in which a container is enclosed, such as is for example disclosed in EP1289874. For cooling a fluid standard cooling system can be used, such as for example in line coolers, compressor type coolers, piezo electric cooling devices, ice banks or the like as known to the person skilled in the art.

In this description dispensing systems will be discussed having one tap per column. However also different numbers of taps could be connected to a single column, whereas a tapping column can have entirely different configurations and construction from the ones having been shown in this description by way of example. For example a second, separate cooling circuit could be provided for cooling the column as such, separated from the beverage line, as discussed in WO2006/103566.

In this description words and indications like substantially and about will have to be understood as at least meaning that slight deviations of a given parameter or feature to which it refers are also considered to have been disclosed, for example at least deviations of about 15% or less, more specifically at least 10% or less. In this description heat conductivity is to be understood as thermal conductivity, the property of conducting heat (W/(m·K)).

A beverage dispensing assembly 1 according to this description, as for example shown in FIGS. 1 and 2 can comprise a tapping column 2 and a tap 3 connected to the tapping column 2 at a first end 4 thereof. The tapping column 2 can comprise a first channel 5 and a second channel 6. The first and second channel 5, 6 can be in fluid communication near the tap 3, for example by a chamber 7. A beverage line 8 extends through one of the first 5 and second channel 6 and is or can be connected to the tap 3. The tap 3 of the assembly 1 comprises at least a first part 9 and a second part 10. The second part 10 at least partly surrounds the first part 9, preferably at an outside thereof. The first part 9 can be made of a first material and the second part 10 of a second material. The second material preferably has a heat conductivity which is higher than the heat conductivity of the first material. The beverage line 8 is connected to the first part 9. At least a part 10A of the second part 10 extends into the chamber 7 into which the first and second channel 5, 6 open. The chamber 7 thus forms a fluid connection between the first and second channels 5, 6.

During use a cooling medium such as but not limited to a fluid, for example water or glycol or a mixture of water and glycol or such freezing temperature reducing agent is fed through the first and second channel 5, 6 and the chamber 7, along the beverage line 8, such that it comes into close contact with at least the part 10A of the second part extending into the chamber 7. The first part 9 can be made of a material having a heat conductivity which is lower than that of the material of the second part 10.

The first part 9 is made of a material suitable for direct contact with the beverage, which is FDA approved, nontoxic and preferably non corroding. Alternatively the first part could be made of plastic. The first part 9 can for example be made of stainless steel. Such first part is easy to maintain, can easily be cleaned and is substantially not prone to lasting contamination.

The second part 10 is preferably made of a material suitable for transferring cold from a cooling medium flowing passed it to the first part, such as a highly heat conductive material. The assembly is preferably constructed such that the second part does not come into contact with the beverage when being dispensed and therefore less constraints could be relevant to the material of the second material with respect to for example beverage contact. The second material can be a metal or metal alloy, such as light metal or light metal alloy. In this context light metal should be understood as at least meaning a metal or metal alloy having a mass of about 5000 kg/m3 or less, such as for example but not limited to aluminum, magnesium and alloys thereof. The second material can be plastic. The second material can for example be copper, bronze or brass.

As is shown in for example FIGS. 2, 3 and 7-12, the tap 3 can be provided with a heat insulation 11. The heat insulation 11 can for example be foam or any other suitable material known to the skilled person. In the embodiment shown the heat insulation can be enclosed within a wall of the tap 3, for example between an inner wall part 12 and an outer wall part 13. An air space 14 can also be provided between the insulation 11 or inner wall 12 and the second part 10. The outer wall part 13 can for example be made of metal, such as stainless steel, or of plastic or any other suitable material, which may be metallized to provide a metal surface or at least a metallized appearance of the surface or the tap 3. The heat insulation can form or can be part of a heat insulation shield 59, as will be discussed.

As is shown in for example FIG. 2-12, the tap 3 is connected to the tapping column 2 by a shank 16. A heat insulating connector 15 is provided for connecting the shank 16 and back part 28 to the column 2, as shown e.g. in FIGS. 2 and 3. The insulating connector 15 can for example be a plastic and/or foamed ring insulating the shank 16 and thus the first and second part 9, 10 from thermal contact to the column 2, such that cooling of the column 2 by cooling medium flowing through the channels 5, 6 and the chamber 7 will be minimized and preferably avoided. The connector 15 can be mounted in an opening 17 at the upper first end 4 of the column 2 in any suitable way, for example by screwing, press fit, form lock or any other suitable means and preferably closes off the interior of the column 2, which may for example be hollow or be filled with an insulating medium and/or can comprise other provisions, such as for example a second cooling circuit as is known from WO2006/103566 or can be in suitable for circulating cooled air from a refrigerator on which the column 2 can be mounted or to which it can be connected.

The beverage line 8 can be connected to the first part 9 at a rear end thereof in any suitable way. In the embodiments shown in e.g. FIG. 2, 3, 6-9 the beverage line 8 can be connected to the first part by a quick coupling 35 as known in the art. In the embodiments shown a quick coupling is shown known as a JG connection.

FIG. 2 schematically shows the tapping column 2 connected to a cooling system 20 in fluid connection with the first 5 and second channel 6 of the tapping column 2. The cooling system comprising at least a circulating device 21 for circulating a cooling medium through at least the first and second channel 5, 6 and the chamber 7. In the embodiment shown a first line 22 connects the cooling system 20 and the circulating device 21, which may be a pump, to the second channel 6. A second line 23 connects the first channel 5 with the cooling system 20. Thus cooling medium can be circulated through the second and first channel 5, 6 and the chamber 7.

The beverage line 8 extends in the embodiment shown through the first channel 5, from a container 25 to the first part 9, coupled thereto as discussed. Thus the first channel 5 and the beverage line 8 form a tube-in-tube within the column 2. In the embodiment shown the first channel is de facto extended to the container 25 by a tube 24 connected to the first channel 5, such that substantially the whole length between the container 25 and the tap 3 is formed by a tube-in-tube in which the beverage line 8 is submerged in i.e. surrounded by the cooling fluid. The tube can be flexible or rigid or a combination of the two. In the embodiment shown the beverage and cooling medium can be in counter flow, such that the cooling medium enters the chamber 7 through the second channel 6 and flows along the beverage line back to the container 25 and then further to the cooling system 20, whereas the beverage flows from the container 5 to the tap 3 in counter flow, optimizing cooling. However obviously the flow of the cooling medium could also be in opposite direction.

Instead of the tube-in-tube 24, 8 also a known in line cooling system for the beverage can be used for cooling the beverage. The container 25 could be cooled in a refrigerator space, such as for example known from EP1289874 and WO2006/103566, and, if the distance between the container and the tap 3 is relatively short, then further cooling of the beverage between the container 25 and the column 2 may not be necessary. Other means known to the skilled person for cooling and forwarding a cooling fluid can also be used in the present invention.

A standard container 26 of pressurizing gas such as but not limited to CO2. N2, air or mixtures of such gasses can be provided for pressurizing the beverage in the container 25 as is well known in the art, either by directly forcing the gas into a compartment of the container containing the beverage, or in between a bag containing the beverage and an outer wall of the container, as for example in a BIC or BIB, or for compressing a container containing the beverage.

As is for example shown in FIGS. 2 and 3, 8 and 9 the tap 3 will comprise a valve 18 operated by a handle 19 in any suitable way as is known in the art. The valve 18 will block or give free a flow path between the beverage line 8 and an outflow end 27 of the tap 3 for dispensing a beverage. The insulation 11 is preferably provided all along the flow path for the beverage through the tap 3, including the valve 18, such that minimal heat transfer will occur between beverage in the tap and surrounding air.

FIG. 4-11 show in more detail embodiments of parts of an dispensing assembly 1 and, especially, of the first and second part 9, 10, the shank 16, the connection of the beverage line 8 and of the tap 3 to the column 2 by the shank 16. A back part 28 can be provided, having a first connection 29, a second connection 30 and a third connection 31. The back part 28 can be made of any suitable material, such as plastic or metal and can for example be cast, injection moulded or be made by any other suitable means. It has been found that it may be favorable to make the back part 28 also of metal, especially brass, in order to increase the heat transfer to the tap 3 and/or for manufacturing purposes, especially strength. Especially since the tap 3 has to be mounted to the shank held by said back part to the column. The first channel 5 can be coupled to the first connection 29, the second channel 6 can be connected to the second connection 30 and the shank 16 can be connected to the third connection 31. As is e.g. shown in FIG. 4-11 the connector 15 can be mounted on the shank 16, between a flange 32 of the shank 16 and a flange of the back part 28. In this embodiment the shank 16 is screwed into the back part 28. The first and second channels 5, 6 can for example be formed by flexible tubes, for example plastic tubes. In use the back part 28 will be mounted inside the column 2, behind and/or in the opening 17, preferably with the thermal insulating ring 15 between the back part 28 and the edge of the opening 17. The shank 16 can then be mounted into the back part 28, preferably with a further thermally insulating ring 15A between the flange 32 and the tapping column 2. Thus the back part 28 and shank 16 are thermally insulated from the column 2. To this end the column 2 can be provided with a hatch, lid or door or such closable entrance for providing access to the interior of the column, such that at least the back part can be mounted.

In the embodiments shown the shank 16 has a part 36 forming part of a wall 32 of the chamber 7. The second part 10 has a substantially tube like shape with a rear end 37 extending into the chamber 7 and a section 38 substantially enclosed by and in close contact with the shank 16 for mounting the tap 3. A length of the second part 10, formed by part 10A, extending between said rear end 37 and the said section 38 extends inside the chamber 7. On the section connecting means can be provided for connecting the second part 10 to the shank 16. Between the part 10A of the second part 10 and the wall part 36 of the shank 16 an annular part 40 of the chamber 7 is formed, increasing the contact surface for the cooling medium and the first part 9 and, especially, second part 10. The first part 9 is provided inside the second part 10, such that it is at least partly surrounded thereby. In the rear part 10A of the second part 10 a chamber 41 is formed for containing the quick coupling 35. The tap 3 can be fitted in the shank 16 in any suitable way, for example by screw threads 42 or by bayonet fixture, by press fitting, form closure or any other suitable means. Preferably the tap 3 can be mounted and remounted, such that it can be pulled at least partly out of the shank 16, such that the beverage line 8 can be easily connected or released from the tap 3. This may enable easy maintenance and repair.

For example in the embodiment as shown in FIG. 4-7 the tap 3 can have a second part 10 formed by an outer portion 43 and a first part formed by an inner portion 44. The inner portion 44 can have a rear facing the chamber 41 for receiving the coupling 35, a neck portion 45 and a forward portion 46 widening away from the chamber 41 and the neck 44. A compensator 47 of the tap 3 can be pushed into the widening portion 46 such that a seal 48 can seal against the inside of said part 46, thus providing a fluid tight connection.

In FIGS. 10 and 11 an alternative embodiment is shown, wherein the tap is of the free flow type, meaning without a compensator as disclosed in the embodiment of FIG. 4-7. In this embodiment the inner portion 44 forming the first part 9 or part thereof is substantially straight and open, covering the inside of the second portion 43 forming the second part 10 or part thereof.

In preferred embodiments the first part 9 and, more preferably all parts up to and including the valve, coming into direct contact with the beverage are made of stainless steel. In preferred embodiments the second part is preferably made of a highly thermally conductive material, such as but not limited to copper, bronze or brass. Brass is a preferred material because of the high thermal conductivity. Alternatively other materials can be used for the second part, such as but not limited to light metal.

By way of example only, stainless steel (inox) is known to have a heat conductivity (W/(m·K)) of less than 24, whereas bronze has a heat conductivity known to be between 42 and 50, brass between 109 and 125 and copper between 350 and 400. Aluminum (pure) can have a heat conductivity of between 204 and 250. Preferably a material is chosen having an optimal combination of heat conductivity and mechanical strength, especially for the second part to be fitted into the shank.

As is shown in FIG. 12 in partly exploded view, the tap 3 can have a tap body 60, for example a substantially cylindrical tap body 60, with a longitudinal axis L extending between the end 10A of the tap inside the chamber 7 and an opposite end 61. The insulation shield 59 has a substantially cylindrical inner chamber 62 fitting snugly over said tap body 60 and a closed end 63 fitting over the end 64 of the tap body 60 opposite the end 10A extending inside the chamber 7. As is shown schematically in FIG. 12 the tap can have a removable spout 65 and a removable tapping handle 19, such that the shield 59 can be slid over the tap body 60 from the end 64 opposite the tapping column 2, when the spout 65 and tapping handle 19 have been removed. The spout 65 can be mounted to the tap body 60 through an opening 67 in the shield 59. The tapping handle 19 can have a forked mounting part 68, in a known manner, having two legs 69 extending on either side of the tap body 60. Each leg 69 can be connected to the valve 18, through appropriate openings 71 in the shield 59. The spout 65 and/or the tapping handle 19, especially the legs 69 thereof are preferably thermally insulated from the further tap. To this end the legs 69 can be connected to the valve through heat insulating elements 70, such as discs. The spout 69 can be made entirely or partially of a material having a low heat conductivity, such as appropriately chosen plastic.

Preferably the spout is thermally insulated and has low conductivity, such that it warms up towards room temperature relatively quickly after dispensing of cooled beverage has been terminated, whereas preferably also any beverage left inside the spout is reduced to a minimum directly after closure of the valve 18, such that dripping is prevented and moreover the moisture inside the spout is minimal. Surprisingly it has been found that this improves the micro climate and microbiology inside the spout considerably and prevents contamination once dispensing is started again. Moreover, by making the spout easily removable it can be exchanged for a new spout easily, for example when changing a container for a new one, again improving hygiene. The channels 5, 6 inside the column are preferably also thermally insulated relative to the column.

By cooling the tap 3 and especially the tap body and valve 18 not too far the shield 59 can have an acceptable thickness to provide an appealing appearance. For example such that the spout at least extends well below a lower part of the shield and the shield has a largest cross section perpendicular to the axis L which is for example in the same order of or smaller than an average cross section of the tapping column 2, perpendicular to a longitudinal axis D of the column 2.

In embodiments a the first and second part 9, 10 could be integrated and for example be made of the same material, such as but not limited to stainless steel or brass.

In use the column 2 is mounted to an appropriate surface, such as a bar, a top of a refrigerator or the like, by inserting a lower portion 52 of the column 2 through an opening in said surface, such that an end 50 comes to rest on said surface and screwing ring 51 against the lower side of the surface. This is in itself a known manner of mounting a column 2 and other known means for mounting the column can also be used alternatively, for example screwing or bolting the column directly onto a surface. The first and second channels 5, 6 are connected to the cooling device 20 as shown. A beverage line 8 can be inserted through the first channel 5 such that a forward end emerges from the opening 17 outside the back part 28, such that it can be engaged outside the column. The end of the beverage line 8 can then be inserted into the coupling 35, where after the tap 3 can be inserted into the shank 16 mounted on the column. The shield 59 is then mounted over the tap body 60 and the spout 65 and handle 19 are appropriately mounted on the tap body 60, through the shield 59.

By preventing condensation or at least reducing condensation on the tap 3 to a minimum it can be prevented that the spout 69 becomes moist by such condensation flowing to and over the spout, which could be detrimental to the hygiene and appearance of the tap 3, especially of the spout 65.

A container 25 can be connected to the opposite end of the beverage line 8, and the gas container 26 can be connected to the container 25, in a known manner. Then cooling medium at an appropriate temperature can be circulated through the first and second channels 5, 6 and the chamber 7 for cooling the beverage line 8 and especially beverage therein, as well as the tap 3 through the thermal contact between the cooling medium and the first and/or second parts 9, 10 in the chamber 7. The heat conductivity and especially the ability to transfer cold by the first part 9 and especially the second part 10 and the insulation the tap 3 and the connection between the shank 16 and/or the back part 28 and the column 2 will provide for an appropriate cool temperature of the beverage, even in the tap 3 before dispensing. This ensures not only a proper dispensing temperature of the beverage but also a proper micro climate and thus improved hygiene of the tapping assembly and especially the tap over prior art systems, in an easy and reliable manner. Preferably the cooling medium is circulated in counter current to the flow of beverage.

In an example the cooling medium is cooled to a temperature such that the beverage in the beverage line in the chamber 7 is for example lower than about 4° C., more specifically about 3° C. or less. The tap 3 and shield 59 can be designed such that transfer by conducting of cold from the fluid in the chamber through the tap body leads to a temperature of the tap body 60 at or in the valve 18 which is slightly higher than in said chamber 7, for example a temperature of about 6° C., which still provides for acceptable hygiene and can be shielded with a relatively thin shield 59 in order to minimize or prevent condensation on the outer surface of the shield.

FIG. 8 shows part of an alternative embodiment of a tapping column 2, wherein the top of the column 2 is angled instead of dome shaped. As can be seen in FIGS. 2, and 3, 8 and 9 the channels 5 and/or 6 may be heat insulated as well.

FIG. 9 shows schematically part of a further alternative embodiment of a column 2, wherein at a side facing away from the tap 3 and thus in oral use facing a customer a cooled portion 55 of the column 2 is shown, which can be connected to a secondary cooling circuit or can be cooled in a different manner, for example by a piezo electrical cooling, such that said portion 55 can freeze and provide for a frozen outer surface part of the column. Similar cooled portions can be provided in different positions.

A tap 3 provided with heat insulation along a flow path for beverage there through can also be used with different dispensing assemblies, with the same or similar effects. The shield 59 can have different configurations and can be adapted to be placed over, especially slipped over different tap bodies.

By having the second part extending along a large part of the length of the first part cold can effectively be transferred to the shank 16 and thus to the tap 3, providing for optimized cooling in a practical and efficient way.

FIGS. 13 and 14 show in cross section and in exploded view a lighting system 100 for a beverage tap, such as for example shown in FIG. 1-12. A similar lighting system 100 can be used in other tapping systems. Tapping systems such as beer taps can be provided with a lighting system for lighting the beverage when being dispensed from the spout 65 of the tap. The spout 65 forming the outlet of the tap provides for a proper flow of the beverage from the tap 3. It is appreciated to improve the visual appearance of the flow by lighting the flow. It is known to provide a light source inside the tap 3, such that the light of the light source emitted radiates out of the tap 3 through the spout 65 and thus through the flowing beverage. A disadvantage of such system is that the light source is inside the space flowed through by the beverage. This makes the light source vulnerable and moreover may influence the beverage, for example because of added heat from the light source. Furthermore providing the light source inside the tap is difficult and necessitates providing energy into the tap, which can provide sealing issues.

In the present disclosure a lighting system 100 is provided for lighting a flow 101 of a beverage such as beer from a spout 65, without the light source being provided in the flow path of the beverage. The beverage will not come into contact with the light source 102. The spout 65 is provided with at least one light path 103 extending from a light inlet 106 near a wall 104, especially an outer wall of the spout 65, and a light outlet 108 at a lower end 105 of the spout 65, near or at the outlet 107 of the spout 65. The light source 102 is positioned at or near the light inlet 106, such that the light from the light source 103 enters into the light path or light paths 103 and exits through the light outlet 108, alongside and/or into the flow 101 emitted from the spout 65. Preferably multiple light paths 103 are provided around the periphery of the spout 65, such that light is emitted on different, preferably all sides of the flow 101 and/or into the flow 101 from different and preferably all sides of the flow 101, or a single light path 103 extending substantially all around the flow 101, as for example will be described hereafter.

In the embodiment shown the spout 65 comprises a core part 109 made of a light transmitting material, such as a transparent and/or opaque material, for example plastic, such as for example Perspex, PC, PP, PE or the like, or glass, such that the core part 109 provides for a light pipe around a beverage channel 110 extending through the spout 65, at the end of which the beverage outlet 107 is provided. Thus the light outlet 108 will basically form a ring around the outlet 107 and thus around the flow 101, emitting the light around and/or into the flow 101. The inner wall of the core part 109 may be made of the same material, for example formed by the inside of the core part 109, or can be covered by another material, such as a non transparent or opaque material, for example a coating 111. The outer side 112 of the spout 65, around the core part 109, can be covered by an outer layer, preferably a layer non transparent to light, such that all light is channeled through the core part 109. The layer 112 can for example be a metallic layer or a layer having a metallic appearance. The spout 65 can be made for example by injection moulding, such as for example by 2- or 3K moulding, over moulding, spray coating or other suitable methods known to the skilled person.

In the embodiment shown a lens 113 is provided in front of the light source 102, more specifically between the light source 102 and the light inlet 106 such that the light is transmitted into the light path 103 or light paths 103, such as the core part 109, properly. The spout 65 can be provided with an outwardly extending flange or shoulder 116, which can abut the lens 113 and/or light source 102 and effectively form the light inlet 106. The full circumferential extend of the flange or shoulder 116 can form the light inlet 106, such that when the spout 65 is placed into the tap 3, for example screwed, it is less critical how the flange or shoulder 116 is positioned relative to the light source 102 and/or lens 113.

The light inlet 106 can be positioned spaced apart from the lower end 105 and the opposite upper end 114. At the upper end 114 a coupling provision 115 can be provided, for example screw threads, such that the spout 65 can be properly mounted into the tap 3. Preferably removably such that it can easily be exchanged. A further stop element such as a 117 or similar provision can be provided on the spout 65 in order to properly position the spout by defining the extend to which it can be entered into the tap or tap housing 59.

In the embodiments shown the light source 102 and lens 113 are provided on a shield 118 mounted on the tap 3, more specifically on the tap housing 59. Although they can also be provided on a different part of a tap 3, for example in or near the handle 19. In the embodiments shown the shield 118 is provided at a front end of the tap housing, over the insulation 11. The shield 118 may be partly or entirely made of a light transparent material and can for example bear a logo. The shield 118 may be lit from the side facing the insulation 11 by the light source 102 or a further light source (not shown). The light source 102 or at least the lens 113, if provided, may extend out from the shield 118 such that when the shield 118 is properly placed on the housing 59, the light source 102 and/or lens 113 protrudes into the space into which the spout 65 is to be mounted, such that the light inlet 106, especially the shoulder or flange 116 is positioned in the direct vicinity of or in abutment with the lens 113 and/or light source 102. The light source can be of any suitable type and preferably comprises one or more LED's, OLED's or the like light source with relatively low energy consumption. The light source can for example be connected to a battery enclosed in the housing 59, e.g. between the shield 118 and the insulation. Alternatively or additionally the light source can be connected to another energy source, for example the mains, directly or indirectly. To that end a plug and socket provision 119 can be provided between the light source 102 and a wiring extending through or along the column 2 and the tap 3. Preferably such that an electrical connection is made when the shield is placed on the housing 59.

In the embodiments shown the light source 102 and any electrically conducting element is kept apart from the flow of beverage through and from the tap 3 and especially in the spout 65. Thus any warmth coming from the light source is kept spaced from the beverage. Moreover making the spout 65 from a non metallic material and preferably a material which has a relatively low heat capacity and making the channel 110 therein substantially free of places in which beverage can accumulate when the tap 3 and especially a valve 18 thereof is closed it is prevented that the spout 65 is cooled too far or at least stays cool for a longer period. It will preferably empty substantially instantly when the valve 18 is closed and thus become relatively dry and will increase in temperature above about 6 to 10° C. or even up towards room temperature relatively quickly, which is preferable with respect to microbiology and hygiene in general.

The light source 102 may be connected to a switch (not shown) with which the light source 102 can be switched on and off. The light source 102 can be kept on during and in between dispense cycles, i.e. when the valve 18 of the tap 3 is open and closed. Alternatively the switch can be operated for example by the tapping handle 18 or by a beverage flow 101, such that only when beverage is dispensed the light source is on and light is emitted from the light outlet 108. For example when the handle 18 is tilted forward, opening the valve 18, the light source 102 can be on whereas when it is in a rest position, closing the valve 18, the light can be off. Obviously in other embodiments the light source 102 can be kept on and light emission between the light source 102 and the or all light path(s) 103 can be blocked, for example by a valve part moving in between, by moving a shutter in between or by altering the lens properties electrically or mechanically, such that the shields is illuminated permanently whereas the light is only emitted through the light outlet 108 when a flow 101 of beverage is dispensed. Such shutter can for example be operated by the flow 101 of beverage.

The invention is by no means limited to the embodiments specifically disclosed and discussed here above. Many variations thereof are possible, including but not limited to combinations of parts of embodiments shown and described. Cooling can be obtained in any suitable way, including but not limited to contact cooling, cooling of the air in the chamber, or any other such suitable means.

These any many other variations are considered to fall within the scope of the present invention.

The invention claimed is:

1. Beverage dispensing assembly, comprising a tapping column and a tap connected to the tapping column at a first end thereof, wherein the tapping column comprises a first and a second channel, in fluid communication near the tap, and a beverage line extending through one of the first and second channels and connected to the tap, wherein the first and second channel are in fluid connection with each other in a chamber and wherein the tap has an end which extends into said chamber, such that at least part of said chamber extends around an outside part of said end, wherein the beverage line extends through said chamber for connection to said end of the tap, such that during use beverage inside the tap is cooled by thermal conduction from cooling medium flowing through said chamber, wherein the tap is provided with a thermal insulation shield, wherein the assembly comprises a first part and a second part connecting the tap to the column and the tapping line, the second part at least partly surrounding the first part, wherein the beverage line is connected to the first part and the second part extends into and/or forms part of a wall of the chamber into which the first and second channel open, forming the fluid connection.

2. Beverage dispensing assembly according to claim 1, wherein the first part is made of a first material and the second part is made of a second material, the second material having a heat conductivity which is higher than a heat conductivity of the first material.

3. Beverage dispensing assembly according to claim 2, wherein the first material is stainless steel.

4. Beverage dispensing assembly according to claim 2, wherein the second material is copper, bronze or brass.

5. Beverage dispensing assembly according to claim 1, wherein the beverage line is connected to a beverage container and a tube extends along at least most a length of the beverage line between the container and the channel of the tapping column through which the beverage line extends.

6. Beverage dispensing assembly according to claim 1, wherein a cooling system is provided which is in fluid connection with the first and second channel of the tapping column, the cooling system comprising at least a circulating device for circulating a cooling medium through at least the first and second channel and the chamber and, if provided for, the tube surrounding the beverage line.

7. Beverage dispensing assembly according to claim 1, wherein the beverage line is connected to the first part by a quick coupling.

8. Beverage dispensing assembly according to claim 7, wherein the tap has a removable spout and a removable tapping handle, such that the shield can be slid over the tap from an end opposite the tapping column when the spout and tapping handle have been removed, and wherein the spout and tapping handle can be mounted to the tap through openings in the shield.

9. Beverage dispensing assembly according to claim 1, wherein the tap is a free flow tap.

10. Beverage dispensing assembly according to claim 8, wherein the spout and/or the tapping handle are thermally insulated.

11. Beverage dispensing assembly, comprising a tapping column and a tap connected to the tapping column at a first end thereof, wherein the tapping column comprises a first and a second channel, in fluid communication near the tap, and a beverage line extending through one of the first and second channels and connected to the tap, wherein the first and second channel are in fluid connection with each other in a chamber and wherein the tap has an end which extends into said chamber, such that at least part of said chamber extends around an outside part of said end, wherein the beverage line extends through said chamber for connection to said end of the tap, such that during use beverage inside the tap is cooled by thermal conduction from cooling medium flowing through said chamber, wherein the tap is provided with a thermal insulation shield, wherein the tap is coupled to the tapping column using a shank, wherein the shank is coupled to the tapping column by a heat insulating connector.

12. Beverage dispensing assembly, comprising a tapping column and a tap connected to the tapping column at a first end thereof, wherein the tapping column comprises a first and a second channel, in fluid communication near the tap, and a beverage line extending through one of the first and second channels and connected to the tap, wherein the first and second channel are in fluid connection with each other in a chamber and wherein the tap has an end which extends into said chamber, such that at least part of said chamber extends around an outside part of said end, wherein the beverage line extends through said chamber for connection to said end of the tap, such that during use beverage inside the tap is cooled by thermal conduction from cooling medium flowing through said chamber, wherein the tap is provided with a thermal insulation shield, wherein the thermal insulation shield can be slid over the tap.

13. Beverage dispensing assembly according to claim 12, wherein the tap has a substantially cylindrical tap body with a longitudinal axis extending between the end of the tap inside the chamber and an opposite end, wherein the insulation shield has a substantially cylindrical inner chamber fitting snugly over said tap body and a closed end fitting over the end of the tap body opposite the end extending inside the chamber.

14. Beverage dispensing assembly according to claim 12, wherein the thermal insulation shield can be slid over the tap from an end opposite the tapping column.

15. Beverage dispensing assembly, comprising a tapping column and a tap connected to the tapping column at a first end thereof, wherein the tapping column comprises a first and a second channel, in fluid communication near the tap, and a beverage line extending through one of the first and second channels and connected to the tap, wherein the first and second channel are in fluid connection with each other in a chamber and wherein the tap has an end which extends into said chamber, such that at least part of said chamber extends around an outside part of said end, wherein the beverage line extends through said chamber for connection to said end of the tap, such that during use beverage inside the tap is cooled by thermal conduction from cooling medium flowing through said chamber, wherein the tap is provided with a thermal insulation shield, wherein the tap has a compensator with a compensator operating element, the compensator operating element is covered by the insulation shield when mounted over the tap body.

16. Beverage dispensing assembly, comprising a tapping column and a tap connected to the tapping column at a first end thereof, wherein the tapping column comprises a first and a second channel, in fluid communication near the tap, and a beverage line extending through one of the first and second channels and connected to the tap, wherein the first and second channel are in fluid connection with each other in a chamber and wherein the tap has an end which extends into said chamber, such that at least part of said chamber extends around an outside part of said end, wherein the beverage line extends through said chamber for connection to said end of the tap, such that during use beverage inside the tap is cooled by thermal conduction from cooling medium flowing through said chamber, wherein the tap is provided with a thermal insulation shield, wherein the tap comprises a beverage channel and a valve, wherein at least the beverage channel and the valve are heat insulated.

17. Beverage dispensing assembly according to claim 16, wherein the tap has an end for connecting to the tapping column, by fitting said end into a shank, wherein the tap comprises first connecting means for connecting to second connecting means of the shank, said first connecting means are spaced apart from the said end of the tap.

18. Beverage dispensing assembly according to claim 16, wherein the tap comprises, between the valve and connecting means for connecting a beverage line a first and a second part, the second part surrounding at least part of the first part, wherein the second part extends along the connecting means for the beverage line and is made of a heat conducting material.

19. Beverage dispensing assembly according to claim 16, provided with a spout having at least one light path defined by or through a wall of the spout extending around a beverage channel of the spout, wherein a light source is provided spaced apart from said channel for emitting light into a light inlet of the at least one light path, wherein a light outlet of the least one light path is provided near an outflow end of the beverage channel.

20. Beverage dispensing assembly according to claim 16, wherein the tap comprises, between the valve and connecting means for connecting a beverage line a first and a second part, the second part surrounding at least part of the first part, wherein the second part extends along the connecting means for the beverage line and is made of a heat conducting material having a heat conductivity higher than a heat conductivity of the material of the first part.

21. Method for cooling beverage, wherein the beverage is fed to a tap through a beverage line forming part of a tube-in-tube line, such that a channel of the tube-in-tube line is formed surrounding the beverage line, said channel is in fluid connection with a second channel by a chamber at an upper end of a taping column where the tap is connected to the tapping column and to the beverage line, wherein a cooling medium is forced through the chamber in close contact with an end of the tap extending into said chamber, said end surrounded by part of said chamber, wherein the tap is cooled by heat conduction between said cooling medium and at least the said end of the tap, wherein the tap is shielded by a heat insulation shield, wherein the tap comprises at and/or near said end a first and second part, wherein the first part is predominantly cooled by the second part extending at least partly into the chamber and surrounding the first part at least partly.

22. Method according to claim 21, wherein the cooling medium in said chamber has a temperature of less than about 4° C., and the tap has a tap body surrounding a beverage channel and valve, said tap body is cooled to a temperature above the temperature of the cooling medium in the chamber.

23. Method according to claim 22, wherein the cooling medium in said chamber has a temperature of less than about 3° C., and the tap body is cooled to a temperature below about 6° C.

24. Method according to claim 21, wherein the beverage is beer.

25. Beverage dispensing assembly, comprising a tapping column and a tap connected to the tapping column at a first end thereof, wherein the tapping column comprises a first and a second channel, in fluid communication near the tap, and a beverage line extending through one of the first and second channels and connected to the tap, wherein the first and second channel are in fluid connection with each other in a chamber and wherein the tap has an end which extends into said chamber, such that at least part of said chamber extends around an outside part of said end, wherein the beverage line extends through said chamber for connection to said end of the tap, such that during use beverage inside the tap is cooled by thermal conduction from cooling medium flowing through said chamber, wherein the tap is provided with a thermal insulation shield, provided with a spout having at least one light path defined by or through a wall of the spout extending around a beverage channel of the spout, wherein a light source is provided spaced apart from said channel for emitting light into a light inlet of a flow path, wherein a light outlet of the at least one light path is provided near an outflow end of the beverage channel.

* * * * *